United States Patent [19]

Horiuchi

[11] 4,411,214

[45] Oct. 25, 1983

[54] ROWING SCULL

[75] Inventor: Kotaro Horiuchi, Hamamatsu, Japan

[73] Assignee: Yamaha Hatsudoki Kabushiki Kaisha, Iwata, Japan

[21] Appl. No.: 221,052

[22] Filed: Dec. 29, 1980

[30] Foreign Application Priority Data

Dec. 29, 1979 [JP] Japan ..... 54-172716
Dec. 29, 1979 [JP] Japan ..... 54-172717

[51] Int. Cl.[3] ..... B63B 35/72

[52] U.S. Cl. ..... 114/347; 114/363; 440/105; 440/106

[58] Field of Search ..... 9/7, 1.1, 1.7, 6 P; 440/104-110; 152/323; 114/347, 363, 357

[56] References Cited

U.S. PATENT DOCUMENTS

| | | | |
|---|---|---|---|
| 173,220 | 2/1876 | Gower | 440/105 |
| 316,847 | 4/1885 | Taylor | 152/323 |
| 392,867 | 11/1888 | Kerns | 9/7 |
| 509,605 | 11/1893 | Reynolds | 440/108 |
| 3,002,484 | 10/1961 | Dube | 114/123 |
| 3,638,256 | 2/1972 | McIntyre | 9/1.1 |
| 3,795,927 | 3/1974 | Darwin, Jr. et al. | 9/7 |
| 3,898,950 | 8/1975 | Martin | 440/105 |
| 4,185,346 | 1/1980 | Adrian | 9/1.7 |

FOREIGN PATENT DOCUMENTS

| | | | |
|---|---|---|---|
| 65611 | 3/1892 | Fed. Rep. of Germany | 9/7 |
| 1245789 | 7/1967 | Fed. Rep. of Germany | 114/343 |
| 758146 | 1/1934 | France | 440/106 |
| 769457 | 6/1934 | France | 9/7 |
| 416512 | 12/1946 | Italy | 440/106 |
| 72278 | 6/1947 | Norway | 440/106 |
| 15447 | of 1893 | United Kingdom | 440/103 |
| 1427530 | 3/1976 | United Kingdom | 9/1.4 |

*Primary Examiner*—Trygve M. Blix
*Assistant Examiner*—Thomas J. Brahan
*Attorney, Agent, or Firm*—Donald D. Mon

[57] ABSTRACT

A rowing scull with a hull, a cockpit, and a deck fully peripherally interconnecting the cockpit and the hull. A frame extends beneath the cockpit, inside the hull, and is reinforcingly joined to the deck at each side of the cockpit. Outriggers for oarlocks are mounted to the deck. The oarlocks are adjustable as to position and angularity, the stretcher is adjustably mounted, and the rower's seat is uniquely mounted to rails in the cockpit.

7 Claims, 14 Drawing Figures

ROWING SCULL

FIELD OF THE INVENTION

This invention relates to rowing sculls.

BACKGROUND OF THE INVENTION

Sculls constructed according to the prior art generally have the hulls acting as a main strength member, and the deck and cockpit which are connected thereto contribute little to the strength of the hull. Therefore, when outriggers are attached to the side portions of the hull, water is liable to attack the attaching portions and steal into the hull. This increases resistance to travel, and increases the risk of capsizing.

DISCLOSURE OF PRIOR ART

An example of prior art sculls is shown in Wurzberger U.S. Pat. No. 3,611,461. In this patent, an effort is made to provide greater structural integrity by means of a frame which mounts the outriggers to the perimeter of the cockpit.

BRIEF DESCRIPTION OF THE INVENTION

The present invention has been conceived with a view to eliminating the aforementioned disadvantages of the prior art, and includes the feature that the outriggers can be attached to the deck while using the deck as the main strength member, thereby to raise the positions of attachment of the outriggers, and reducing leakage. Specifically, the present invention is characterized in that the cockpit is made integral with the deck, in that the deck is made to act as the main strength member, and in that the deck has both of its side portions connected through the cockpit by means of a frame.

The invention will be fully understood from the following detailed description and the accompanying drawings, in which:

DETAILED DESCRIPTION OF THE INVENTION

Figure 1:
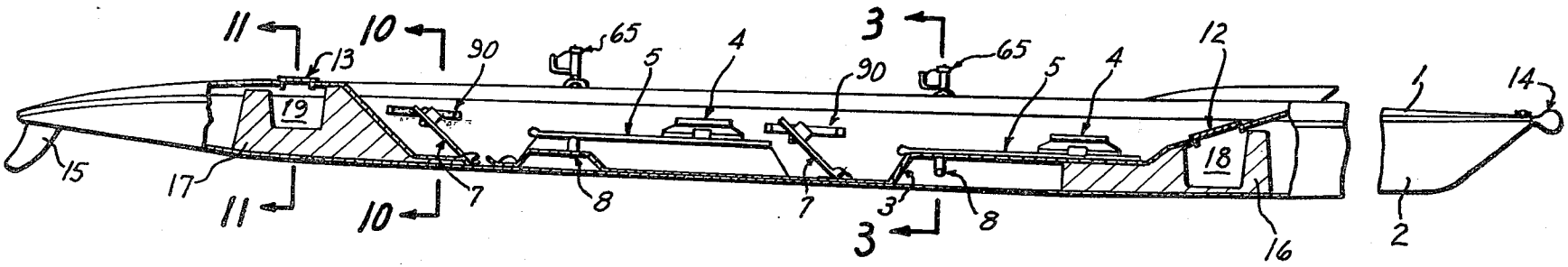
FIG. 1 is a partially cut-away side elevation showing the preferred embodiment of the present invention.
Figure 2:
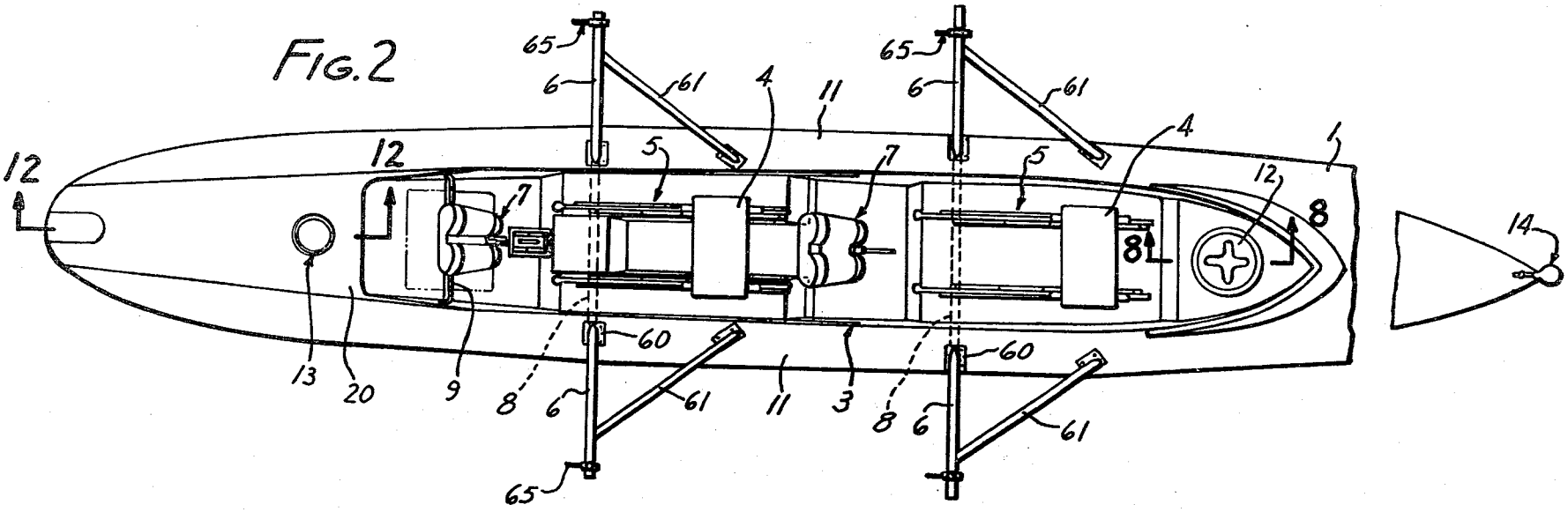
FIG. 2 is a top plan view of the same.
Figure 3:
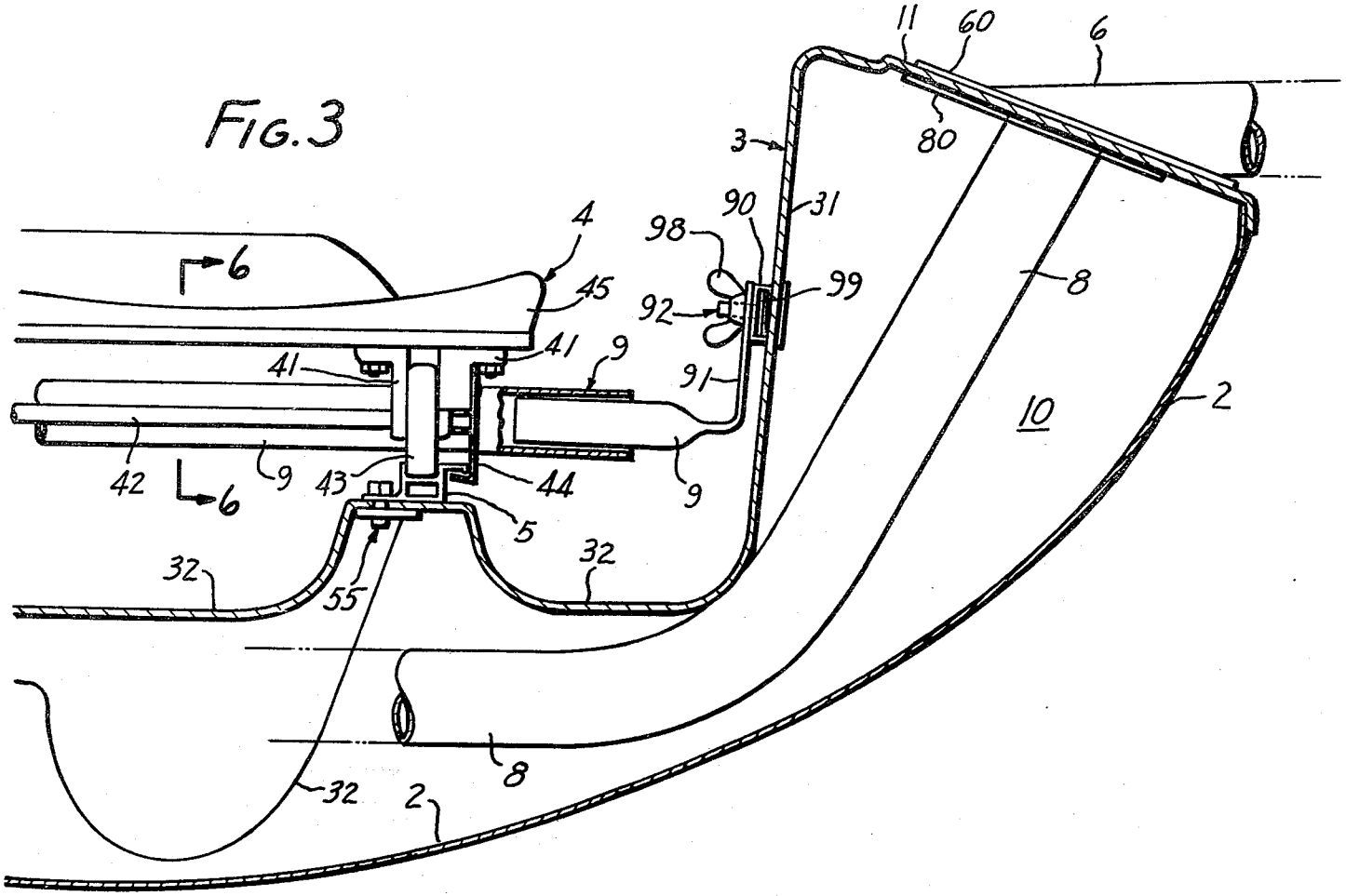
FIG. 3 is a section taken along line III—III in FIG. 1.

An embodiment in which the present invention is applied to a scull made of fiber-reinforced plastic (which will sometimes herein be referred to as "FRP"), will be described herein. In FIGS. 1 and 2: reference numeral 1 indicates a deck; numeral 2 a hull; numeral 4 a slide seat; numeral 5 a pair of rails; numeral 6 a pair of outriggers; and numeral 7 a stretcher. Deck 1 is molded of FRP into a longitudinally integral structure and has its center portion recessed to form a cockpit 3 between its sides. As shown in FIG. 3, deck 1 has its side portions 11 merging into side walls 31 and the bottom wall 32 of the cockpit 3. It is bonded to hull 2 so that its folded end portions clamp the upper edges of the hull 2. Although only one side is shown in FIG. 1, the other side is formed in a symmetrical shape. Side deck portions 11 (i.e. at both sides of the cockpit) are connected to each other by means of a pipe frame 8 which is arranged to extend beneath cockpit 3 in such a manner as to clamp the same. A reinforcing plate 80 is attached to the connecting portion between the cockpit 3 and each respective side deck portion 11. At the outer side of the connecting portion, there is attached one of the outriggers 6, the reinforcing plate 60 of which is fastened to the reinforcing plate 80 through the corresponding side deck portion 11 by means of a bolt (not shown).

Figure 4:
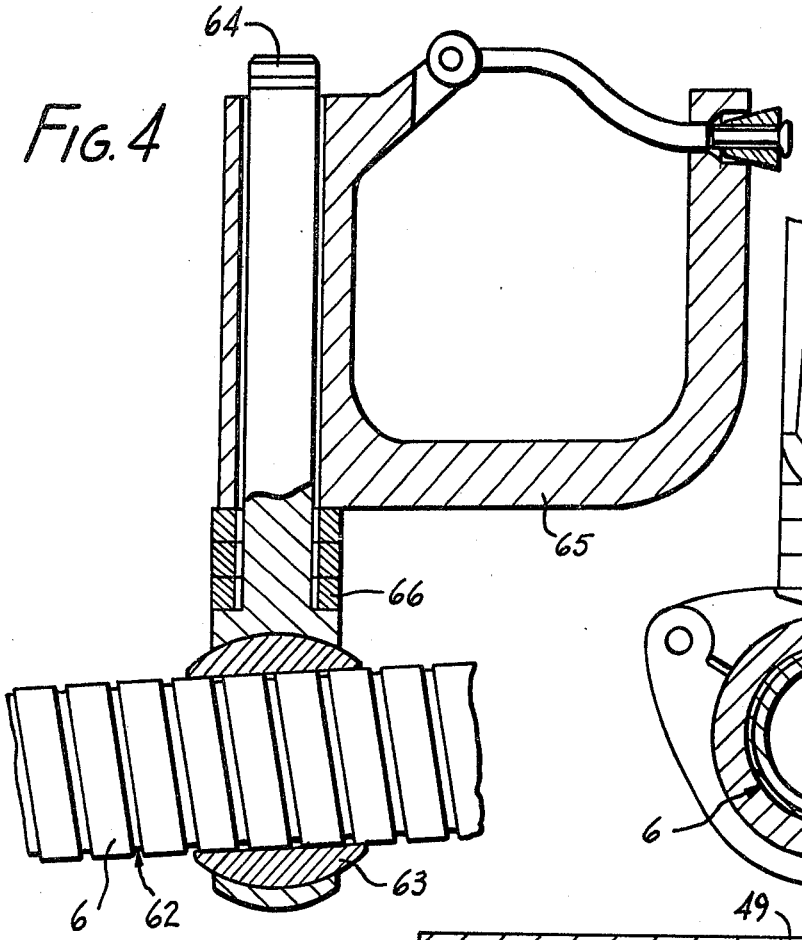
FIG. 4 is a sectional view showing the oarlocks at the leading end portions of the outriggers.
Figure 5:
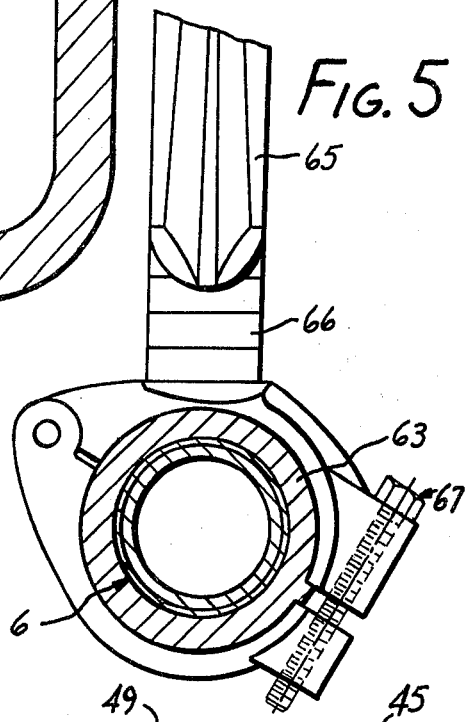
FIG. 5 is a side elevation of the same.

Outrigger 6 is supported by means of a supporting arm 61, which is attached to deck 1, and has a leading end portion formed with threads 62. To threads 62, there is screwed a clamping member 63, to the supporting column 64 of which is rotatably attached an oarlock 65 (as shown in FIGS. 4, 5). Reference numeral 66 shows a spacer.

Clamping member 63 can be fixed in a preset orientation by friction which is effected by tightening a bolt 67. If bolt 67 is loosened, clamping member 63 can be turned along the threads 62 so that the angle of rotation of the oarlock 65 can be set to any desired value. As a result, the swath of the oar blade can be adjusted, and the oarlock 65 can be tilted outward and inwardly. Moreover, the distance of the oarlock 65 from the center of the scull (e.g., the rigger spread) can be adjusted.

With the described construction, deck 1 is integral with the cockpit, surrounds it, and with the cockpit covers the hull. Its side portions are connected and reinforced in the vicinity of the hull and cockpit by means of pipe frame 8 so that it provides the main strength member, having a high strength, for the hull. As a result, outriggers 6 can be attached to deck 1. Moreover, since the positions where the outriggers 6 are attached are high because they are attached to the deck, little water is liable to attack outriggers 6, when the scull navigates, thus obviating the drawback that the attacking water causes resistance and also might flow into the hull, as is often experienced by the prior art wherein the outriggers are attached to the hull itself.

Referring now to FIG. 3, there are provided within cockpit 3 paired rails 5, which are fixed to bottom wall 32 by means of bolts 55. Slide seat 4 is arranged on the rails 5 so that it can slide back and forth. Seat 4 is constructed with a seat portion 45 (made of polystyrene foam) atop the seat base. There are attached to the lower sides of the seat base an even number of bearings 41 for rotatably holding axles 42, to both ends of which are fixed wheels 43. A guide plate 44 is attached to the outer side of the bearings 41 so that wheels 43 may be prevented from leaving the rails 5.

Figure 6:
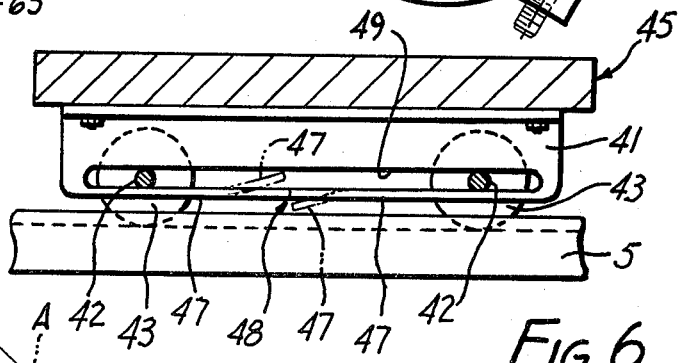
FIG. 6 is a section taken along line VI—VI in FIG. 3.

Each seat 4 is equipped with four wheels 43 which are received in rails 5, as shown, so that they can roll back and forth along rails 5. Each of bearings 41 is formed, as shown in FIG. 6, with a slot 49 through which axles 42 extend and which has its lower portion 47 separated at a separating portion 48 where it is elastically opened at portion 48, as shown in broken lines, so that wheels 43 can be replaced without any difficulty.

On the other hand, because the reciprocating movements of the seat 4 are effected in a manner to correspond to those of the oars, and because the pressure from the rower is not applied completely in parallel with the rails 5, wheels 43 are required to stably roll on the rails 5 even when an eccentric load is applied. In the embodiment being described, because the paired wheels 43 at both sides are fixed to both ends of each axle 42, wheels 43 always maintain their relative relationship with the rails 5 even for an eccentric load, so that they can always smoothly roll on the rails.

Within cockpit 3 there is provided a pair of grooves supporting rails 90 having elongated openings, which rails are fixed to the inner sides of side walls 31, and in which are fitted sliding members 99 with their bolt portions 92 extending through end portion 91 of stretcher supporting beam 9, and fastened by means of a nut 98.

Figure 7:
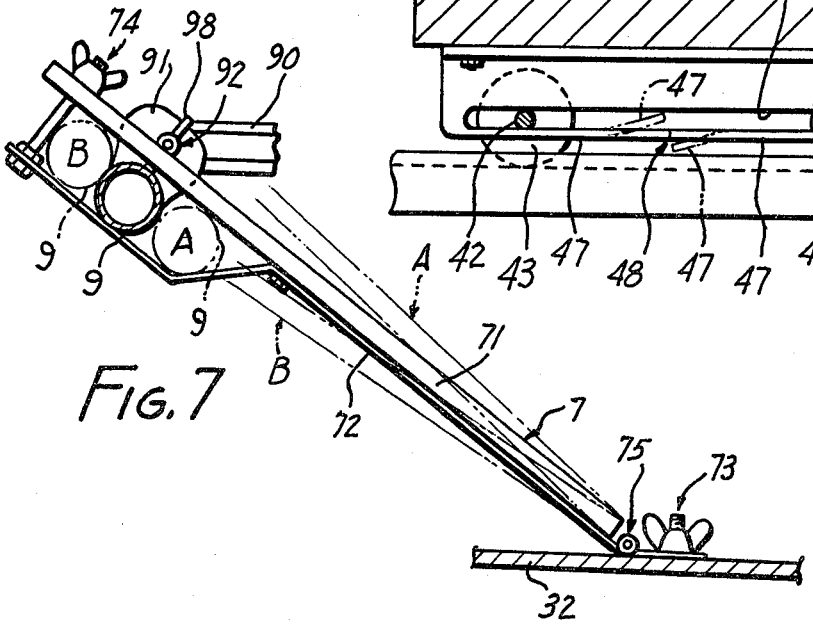
FIG. 7 is a side elevation showing a stretcher used in the scull.

Stretcher 7 is constructed, as shown in FIG. 7, of foot rest 71 and reinforcing member 72. Reinforcing member 72 has its lower end portion fixed to bottom wall 32 of the cockpit by the combination of a bolt and a nut. Its angle of inclination is varied by means of a hinge 75. On the other hand, the upper end of stretcher 7 is connected by a bolt-nut combination 74 so that a preset gap is formed between foot rest 71 and reinforcing member 72. As a result, stretcher 7 is held in a preset angle of inclination by having the aforementioned stretcher supporting beam 9 extending through the gap between foot rest 71 and reinforcing member 72.

Since stretcher supporting beam 9 is made movable from a position A to a position B between foot rest 71 and reinforcing member 72, foot rest 71 can be shifted from position A to position B by changing the attached position of the stretcher supporting beam to the supporting rails. When the attached position is to be changed, it is sufficient to loosen nut 98 and then to fasten nut 98 again after sliding member 99 is shifted to a preset position within supporting rails 90.

Since supporting rails 90 (as shown in FIG. 1) at both sides are attached to both side walls of the cockpit, which are curved in the longitudinal direction, the spacing between is changed in the longitudinal direction. Therefore, when it is intended to change the attached positions of stretcher supporting beams 9, their length must be accordingly changed. However, since each of stretcher supporting beams 9 is composed of telescopic pipes having different diameters so that it can extend and contract, it can always have a length corresponding to the spacing between the supporting rails 90, if changed, thus making it unnecessary to replace supporting beams 9 each time. As shown in FIGS. 3 and 7, because supporting rails 90 are constructed of the grooved member which has a vertically elongated cross-section, they can be bent along and attached to curved side walls 31 of the cockpit without difficulty. Incidentally, if the auxiliary seat is detachably attached by the use of supporting rails 90, the scull can be used not only as a training scull, but also as a usual scull without weight increase.

Figure 8:
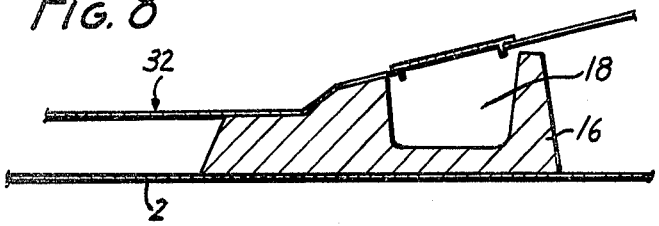
FIG. 8 is a section taken along line VIII—VIII in FIG. 2.
Figure 9:
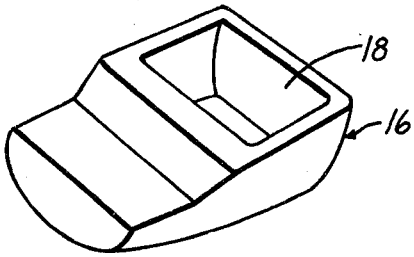
FIG. 9 is a perspective view showing a supporting stool.
Figure 10:
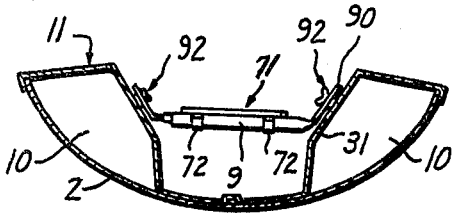
FIGS. 10 and 11 are sections taken along lines X—X and XI—XI, respectively in FIG. 1.
Figure 11:
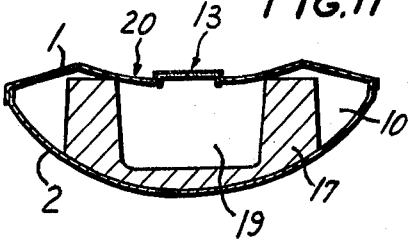
Figure 13:
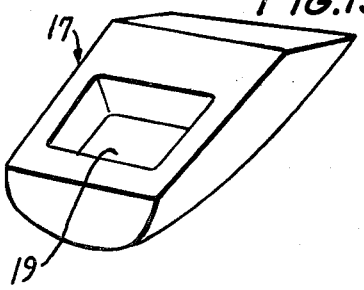
FIG. 13 is a perspective view showing said supporting stool.

Between deck 1 and hull 2, there is formed a sealed space 10, by which the scull is prevented from sinking even if water floods the cockpit 3. Cockpit 3 is formed, as best shown in FIGS. 8 and 9, at its front portion with an open portion which is covered with a cover 12 and within which is arranged a supporting member 16 made of polyurethane foam and acting as a float. The portion of supporting member 16 which faces the open portion is formed with a recess 18 that can be used as a receptacle. On the other hand, the rear portion of cockpit 3 is also equipped, as shown in FIGS. 11 and 13, with a cover 13 for an open portion and with a supporting member 17, which is also formed with a recess 19. Deck 1 is formed at its rear center portion with a grooved recess 20 so that the water, which has entered the cockpit 3 due to acceleration of the scull occasioned by oar rowing action, is expelled along the gentle slope of the rear end of cockpit 3 into grooved recess 20 until it is discharged back along recess 20.

Figure 14:
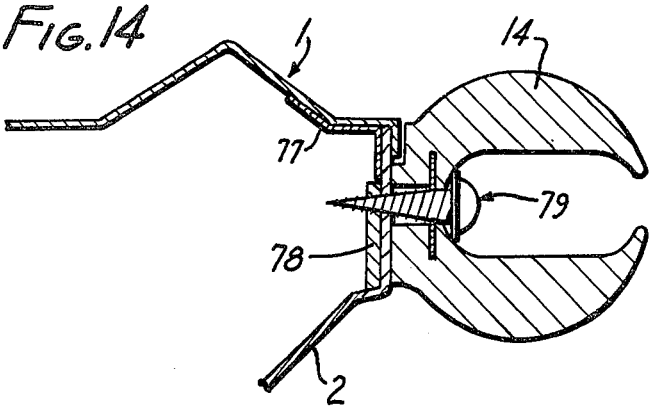
FIG. 14 is a longitudinal section showing the bow portion of the scull.

Turning now to FIG. 14 showing the top ball at the bow of the scull, the folded portions of the deck 1 and the hull 2 are clamped at the bow end of each other and sealed by means of a sealing member 77. Top ball 14 is attached to these portions by fastening a screw 79 through a backing member 78 into them. Screw 79 also acts to connect hull 2 and deck 1.

Figure 12:
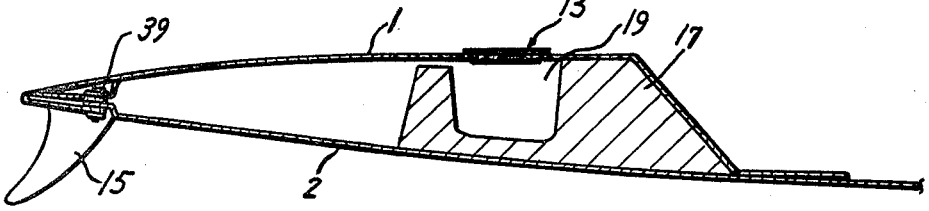
FIG. 12 is a section taken along line XII—XII in FIG. 2.

As shown in FIG. 12, a fin 15 is detachably attached to the stern end of the scull by means of a bolt 39 so that it can be used as a rudder, by loosening the bolt 39.

As has been described herein, the present invention is characterized in that the cockpit is made integral with the deck, in that the deck is made to act as the main strength member, and in that the deck has both its side portions connected through the cockpit by means of a frame. As a result, the thickness of the hull can be reduced, and the outriggers can be attached to the deck, thus eliminating the drawback that water attacks the outriggers, when the scull navigates, thereby to eliminate the resistance to the scull.

This invention is not to be limited to the embodiment shown in the drawings and described in the description, which is given by way of example and not of limitation, but only in accordance with the scope of the appended claims.

I claim:

1. A rowing scull comprising: a hull member comprising a bottom, a sidewall and a continuous edge around said sidewall, a cockpit member having a sidewall and a bottom and a deck member, said deck member having an inner opening and an outer edge, its outer edge being fully sealingly engaged to said hull edge, and a said cockpit member being fully and sealingly connected to said deck member around its said opening; a rigid frame member reinforcingly attached to said deck member at both sides of said cockpit member and extending beneath said cockpit member between said cockpit member and said hull member, without attachment to either the cockpit member or to said hull member whereby said deck member comprises a main strength member for said scull reinforced by said frame member; and a pair of outriggers, each being attached to the top of said deck member at a respective side of said cockpit.

2. A rowing scull according to claim 1 in which each said outrigger is attached to the deck member where the frame member is attached to the deck member.

3. A rowing scull according to claim 1 in which each said outrigger includes an end portion with a thread, and an oarlock and clamping member for said oarlock mounted to said thread for adjustability of position.

4. A rowing scull according to claim 3 in which each said oarlock includes a supporting column, a spherical joint fitting its respective clamping member to said column, and fastening bolts for clamping said member to hold an adjusted position.

5. A rowing scull according to claim 1 in which grooved rails extend longitudinally of the hull along the inner sidewall of said cockpit; a stretcher supporting beam extending laterally, and being slidably adjustable in length to said rails so as to compensate for changes in width of said cockpit.

6. A rowing scull according to claim 1 in which a slide seat is provided in said cockpit member, said slide seat having a lower face, a bearing at each side of said seat having longitudinal extending slots, and a pair of axle and wheel sets mounted in said slots.

7. A rowing scull according to claim 1 in which said reinforcing frame member is spaced from and out of contact with said hull member.

* * * * *